US006478193B1

(12) United States Patent
Good et al.

(10) Patent No.: US 6,478,193 B1
(45) **Date of Patent: *Nov. 12, 2002**

(54) CHILD-RESISTANT NOZZLE ASSEMBLY FOR FLUID DISPENSER

(75) Inventors: Robert J. Good, Raytown, MO (US); Joseph R. Krestine, Leawood, KS (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/907,637

(22) Filed: Jul. 19, 2001

Related U.S. Application Data

(60) Provisional application No. 60/296,129, filed on Jun. 7, 2001.

(51) Int. Cl.[7] ..... B67B 5/00

(52) U.S. Cl. ..... 222/153.14; 215/220; 222/380

(58) Field of Search ..... 222/153.13, 153.14, 222/380, 383; 215/209, 220; 239/333, 538, 359

(56) References Cited

U.S. PATENT DOCUMENTS

| | | | |
|---|---|---|---|
| 2,847,139 | A | 8/1958 | Christiansson et al. |
| 3,782,604 | A | 1/1974 | Kessler |
| 3,841,533 | A | 10/1974 | Carroll et al. |
| 4,204,614 | A | 5/1980 | Reeve |
| 4,257,561 | A | 3/1981 | McKinney |
| 5,050,779 | A | 9/1991 | Knickerbrocker |
| 5,419,077 | A | 5/1995 | Tombarelli |
| 5,477,989 | A | 12/1995 | Maas et al. |
| D386,684 | S | 11/1997 | Marogil |
| 6,145,756 | A | 11/2000 | Kohls |
| 6,227,411 | B1 | 5/2001 | Good |

*Primary Examiner*—Henry C. Yuen
*Assistant Examiner*—Melvin Cartagena
(74) *Attorney, Agent, or Firm*—Dykema Gossett PLLC

(57) ABSTRACT

A fluid dispenser having a child-resistant nozzle assembly requiring a three-step manipulation for the rotation of the nozzle cap about a longitudinal axis thereof between discharge ON and discharge OFF positions. The nozzle cap has at least one stop shoulder with which a manually depressable spring tab on the dispenser body engages to lock the cap in an OFF position against cap rotation. A nozzle cover surrounds the cap and is freely rotatable about the longitudinal axis of the cap and along that axis, the cap and the cover having engaging portions such that when engaged with the spring tab depressed, the cap can be rotated from its OFF position.

16 Claims, 1 Drawing Sheet

FIG. 1
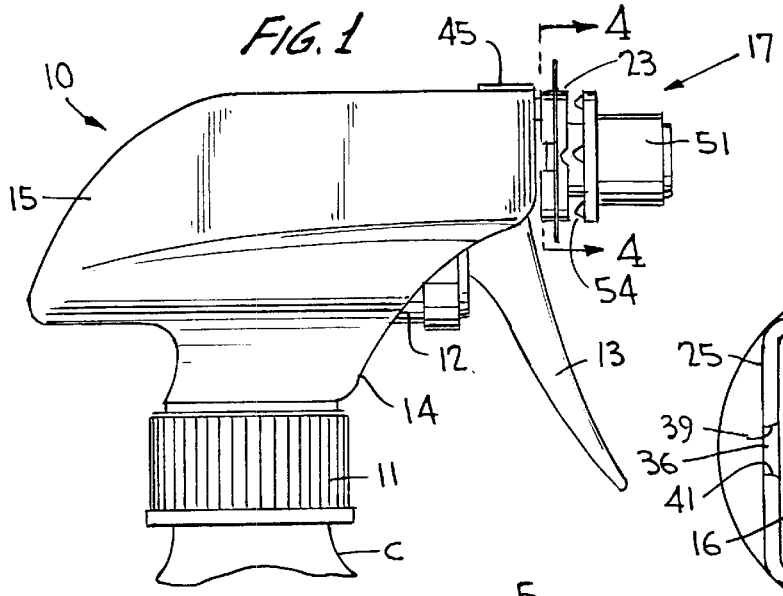
FIG. 4
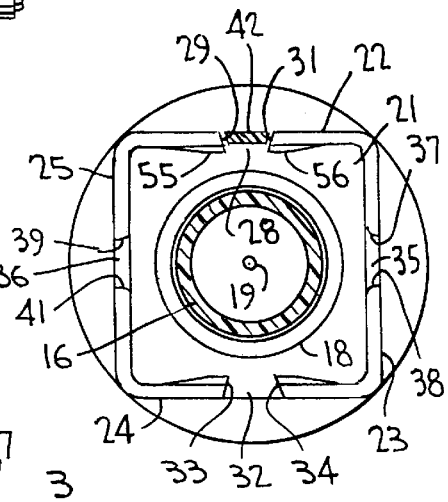
FIG. 2
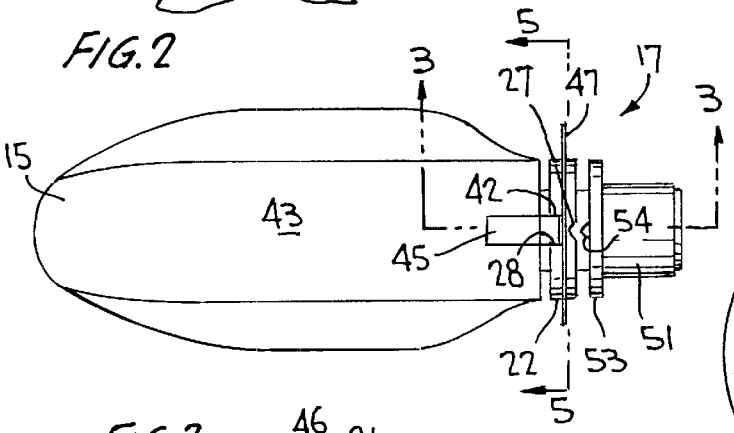
FIG. 5
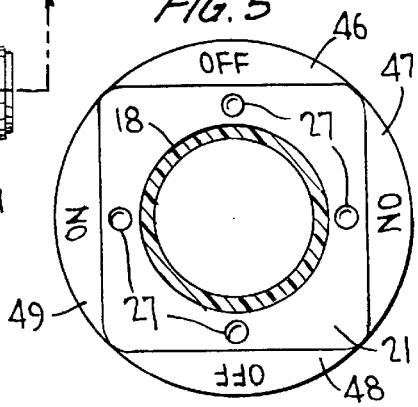
FIG. 3
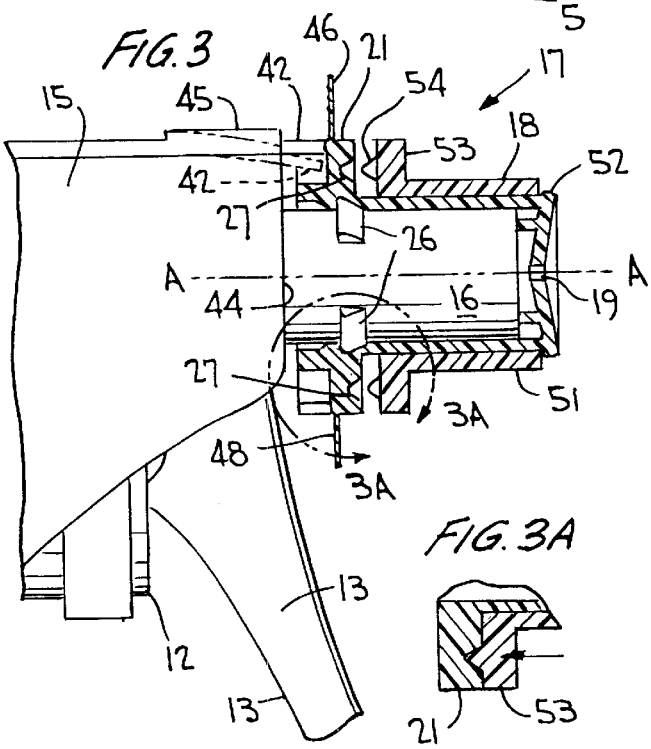
FIG. 3A
FIG. 6
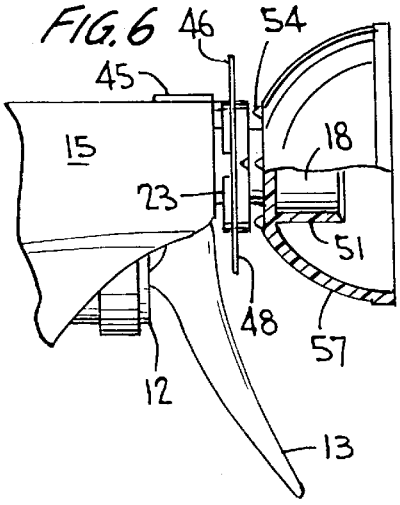

CHILD-RESISTANT NOZZLE ASSEMBLY FOR FLUID DISPENSER

RELATED APPLICATION

This application claims priority based on provisional application Serial No. 60/296,129 filed Jun. 7, 2001.

BACKGROUND OF THE INVENTION

This invention relates to a manually operated fluid dispenser having a child-resistant nozzle assembly requiring a three-step manipulation for rotation of a nozzle cap about its longitudinal axis between discharge ON and discharge OFF positions.

The child-resistant nozzle assembly according to the invention is an improvement over U.S. Pat. No. 6,227,411, commonly owned herewith, in which a nozzle cover surrounds the nozzle cap and is freely rotatable thereabout and is moveable along the longitudinal axis thereof to render the cap child-resistant. Engaging portions on the cap and the cover are longitudinally spaced apart in a first position to prevent cap rotation by rotating the cover, and are interengaged in a second longitudinal position to enable the cap to rotate by the nozzle cover between the ON and OFF positions. A two-step manipulation is thus required for rotation of the nozzle cap from its OFF position, i.e., a longitudinal shifting of the nozzle cover until the engaging portions unite followed by rotation of the cover. While such a solution is relatively simple and inexpensive in construction and highly effective in preventing accidental operation of the dispenser by a child, improvements over this child-resistant nozzle assembly is desirable.

Another type of child-resistant nozzle assembly requiring a two-step manipulation is disclosed in U.S. Pat. Nos. 4,204,614 and 4,257,561 each requiring a two-step manipulation for rotation of a screw threaded nozzle cap to an ON position about its axis from an OFF position. For this purpose a spring biased tab or lug is provided on the dispenser body capable of being manually depressed from the top of the dispenser. A ramp presenting a stop shoulder ('614 patent) or an open slot ('561 patent) is provided on the cap skirt. Thus in the OFF position with the cap threaded down to a completely closed position, the stop shoulder is engaged by a tab ('614 patent) or the lug is received by the slot ('561 patent) to prevent cap rotation. The lug or tab must first be depressed to disengage the stop shoulder or to shift out of engagement with the slot while the cap is unscrewed to shift it to a selected ON position.

Both child-resistant nozzle assemblies are designed for preventing accidental operation of a dispenser by a child where the nozzle cap shifts along its longitudinal axis between ON and OFF Positions. However, it has been found that a strong grip on the nozzle cap while unthreading it can be made to override the engagement by the lug or tab especially if a grip assist of some sort is provided on the cap.

SUMMARY OF THE INVENTION

It is therefore an object of the present invention to improve upon the child-resistant nozzle assemblies of the aforedescribed type by the provision of a child-resistant nozzle assembly for a fluid dispenser which requires a three-step manipulation to thereby enhance the child-resistant properties of the assembly when dispensing especially household or garden fluids which may be toxic or harmful especially when swallowed or when sprayed on one's skin or face.

In carrying out this objective a nozzle cover surrounds the cap and is freely rotatable thereon while being moveable along the axis of the cap. Confronting engaging portions on the cap and the cover are longitudinally spaced apart in a first position to prevent cap rotation by cover rotation thereby preventing nozzle cap rotation from its OFF position. When the nozzle cap is shifted such that the engaging portions interengage, one of a three-step required manipulation is achieved for ultimately effecting nozzle cap rotation.

The dispenser body is further provided with a longitudinally extending spring biased tab engagable with at least one stop shoulder on the nozzle cap in an OFF rotative position thereof. Thus even with the engaging portions between the cover and cap interengaged, the cap cannot be rotated upon cover rotation until the lug is manually shifted out of engagement with the stop shoulder thereby permitting cap rotation upon cover rotation while maintaining the lug depressed.

The stop shoulder on the nozzle cap may be in the form of a slot which is engaged by the tab and which prevents rotation of the cap in either direction. The slot is located at an OFF position of the cap and may have opposing stop shoulders which flare inwardly toward one another to more positively prevent a possible override of the tab on cap rotation. The stop shoulders may include thickened portions of the wall of the cap skirt which are tapered permitting the tab to conveniently spring snap into place upon cap rotation back to its OFF position.

The nozzle cover may comprise a cylindrical skirt, and the skirt may have a dome-shaped windshield extending from an upstream end thereof.

Other objects, novel features and advantages of the invention will be described in more detail in the following when taken in conjunction with the accompanying drawings.

BRIEF DESCRIPTION OF THE DRAWINGS

FIG. 1 is a side elevational view of a fluid dispenser incorporating the child-resistant nozzle assembly according to the invention;

FIG. 2 is a top plan view of FIG. 1;

FIG. 3 is a view similar to FIG. 1 at an enlarged scale and showing the nozzle assembly in vertical section;

FIG. 3A is a detail view at arrow 3A of FIG. 3 showing engaging portions interengaged;

FIG. 4 is a view taken substantially along the line 4—4 of FIG. 1;

FIG. 5 is a view taken substantially along the line 5—5 of FIG. 2; and FIG. 6 is a view similar to FIG. 3 at a reduced scale showing another embodiment of the nozzle cover according to the invention.

DETAILED DESCRIPTION OF THE INVENTION

Turning now to the drawings wherein like reference characters refer to like and corresponding parts throughout the several views, a manually actuated pump dispenser generally designated 10 as shown in FIG. 1 has an internally threaded closure 11 for mounting the dispenser on a container C of liquid product to be dispensed. The dispenser includes an internal pump body which is hidden from view except for a pump piston 12 which is reciprocated within its cylinder by pulling on trigger lever 13 for dispensing liquid product from the container through the nozzle. The pump body is covered by a shroud 14 and the shroud together with the pump body are together referred to herein as a dispenser body 15. Certainly pump dispensers of the type having no external shroud are included within the scope of the present invention. The pump includes a conventional discharge barrel extending from the pump chamber (not shown) which discharge barrel terminates in a discharge nozzle 16 shown most clearly in FIG. 3.

The child-resistant nozzle assembly according to the invention, generally designated 17 in FIGS. 1 to 3, has a cylindrical nozzle cap 18 mounted on the nozzle for rotation about longitudinal axis A—A of the nozzle. Conventional spin mechanics (not shown) within the nozzle and the cap effect a spray discharge of product through discharge orifice 19 of the nozzle cap in the ON rotative position. The structural details relating to the spin mechanics are more clearly shown in U.S. Pat. No. 6,227,411, and the entirety of that disclosure is incorporated herein by reference.

This type of known spray mechanics effects a spray discharge or a stream discharge, or two spray discharges of variable conicity, depending on the fluid spin mechanics provided. Also, a foam assist may be provided to effect a foam discharge in one or both ON positions, as in a manner known in the art. And there are two OFF positions for the nozzle. The nozzle cap may be rectangular in cross-section having four rotative positions, one at each side of the cap. The two OFF positions are located at opposed turning, faces of the cap, and the other two ON positions are located at the other two rotative positions of the cap. The ON positions may be SPRAY, STREAM, and/or FOAM positions.

The nozzle cap has a transversely extending flange 21 of generally rectangular outline. A skirt extends from the four sides of the flange presenting skirt walls 22,23, 24, 25 (see. FIG. 4). The cap is snap fitted to the nozzle via snap beads 26 (FIG. 3) such that the nozzle cap is rotated without longitudinal shifting, as in the U.S. Pat. No. 6,227,411. Engaging portions 27 are formed in the front face of flange 21 which are shown in the form of detents.

Skirt wall 22 located at one of the OFF positions of the nozzle cap is provided with a slot or a cutout 28 parallel to the axis A—A and presenting a pair of opposing stop shoulders 29, 31 which may be perpendicular to the face of skirt wall 22 or which may inwardly converge as shown in FIG. 4.

Similarly, skirt wall 24, in the other OFF position of the nozzle cap, is provided with a slot or cutout 32 likewise having an axis parallel to axis A—A, and being defined by a pair of opposing stop shoulders 33, 34 which may lie perpendicular to the face of skirt wall 24, or which may inwardly converge as shown in FIG. 4

At the ON positions skirt walls 23 and 25 are provided with slots 35 and 36, respectively, each extending parallel to axis A—A, and being respectively defined by opposing shoulders 37, 38 and 39, 41 which may lie perpendicular to the surface of the skirts in which they are located, or which may be radiused so as to inwardly diverge slightly as shown in FIG. 4.

Dispenser body 15 is provided with an integral tab 42 located in top wall 43 of the dispenser body and extending forwardly of forward edge 44 of the body. Top wall 43 is of a plastic material which is inherently elastic thereby rendering the tab spring-biased as it is capable of being manually depressed by applying pressure against a pad 45 aligned with the tab causing the top wall 43 to flex between its opposite sides between an engaged position shown in solid outline in FIG. 3, and a disengaged position shown in phantom outline in that Figure. Otherwise tab 42 may be defined by a pair of spaced slits provided in top wall 43 to render the tab resilient, as shown in the commonly owned U.S. Pat. No. 4,204,614.

The ON and OFF markings as shown in FIG. 5 can be provided on the outer faces of skirt walls 22 to 25 or can be provided on the outer surface of nozzle cap 18, according to the teachings set forth in the commonly owned U.S. Pat. No. 6,227,411. Otherwise these markings can be provided on one or both sides of thin arcuate flanges 46, 47, 48, 49 which together may outline a circle, as shown in FIG. 5 where flanges 46, 48 contain the OFF markings and flanges 47, 49 contain the ON markings. In lieu of ON markings, SPRAY and STREAM markings, two SPRAY markings, or a SPRAY and a FOAM marking, may be provided on flanges 47 and 49, depending on the sprayer.

A cylindrical nozzle cover 51 surrounds nozzle 18 and is freely moveable about axis A—A as well as along that axis, as shown in FIG. 3. The downstream end of the nozzle cap may have a bead 52 providing a limit stop for the cover in its forward position on the cap.

The cover has an annular flange 53 with its rearward face provided with engaging projections 54 when nesting in an engagement with engaging detent portions 27 on the front face of the nozzle cap. Of course, detents 27 or the equivalent may instead be provided on flange 53, and projection 54 on the equivalent may be provided on flange 21, within the scope of the invention.

The nozzle cap is shown in FIGS. 1 to 4 in a position locked against rotation about axis A—A with tab 42 extending into slot 28 in contact engagement with one of the stop shoulders 29 or 31 depending on the direction of the, rotative force applied to the nozzle cap, as will be further described hereinafter. To rotate the cap from its OFF position of FIG. 4, cover 51 is shifted inwardly to its position shown in FIG. 3A with pressure maintained in the direction of the arrow therein as engaging portions 27 and 54 interengage. Manual downward pressure is then applied to pad 45 causing the pad and its lug 42 to spring downwardly to its position shown in phantom in FIG. 3 until its clears the inner side of one of the cams 55 or 56 which respectively form extensions of stop shoulders 29 and 31 as shown in FIG. 4. As shown, the cams are smoothly tapered toward the inner face of skirt wall 22. While the tab 22 remains manually depressed beyond the inner sides of the cams, the operator can rotate the nozzle cap by rotating the nozzle cover with engaging portions 27, 54 engaged. Rotation can, of course, be made in either rotative direction. When the nozzle cap is rotated to a position where lug 42, and slot 28 are out of alignment, the manual pressure applied against 45 can be released and the nozzle cap thereafter be freely rotated to one of the two ON positions lying in the direction of rotation. Tab 42 snaps into engagement with slot 36 (assuming that is the direction of rotation) without the need to depress the tab as the tab is guided into the slot by the radiused shoulder 39. When the nozzle cap is rotated to one of its OFF positions lug 42 need not be depressed since the radiused shoulders 39 and 41 permit and guide the tab inwardly of skirt wall 25 upon application of force applied to the cap up on cover rotation. The feathered edges of the cams at the stop shoulders 33, 34 or 29, 31 permit the tab to enter the corresponding slot 32 or 28 without the need to depress the tab.

Also it should be noted that while in the lock position of FIG. 4 any attempt to rotate the nozzle cap upon rotation of the cover with the engaging portions engaged, without simultaneously depressing tab 42, is positively prevented by stop shoulders 29, 31 or 33, 34, whichever the case, and is enhanced by the inwardly converging and additional length of the stop shoulders to thereby resist any override of the locking tab.

Another embodiment of the nozzle cover is shown in FIG. 6 in which a dome-shaped,spray shield 57 extends from flange 53 of the cover, as shown. The dome is of a larger diameter than the cover, and extends beyond the outer end of the cylindrical nozzle cover. The spray shield is a feature provided for actuating the spray close to a surface. Moreover, the larger diameter dome functions as handle when grasped by the operator to assist in rotating the nozzle cover. However, as in the aforedescribed embodiment, the nozzle cap cannot be rotated from its OFF position even with engaging portions 27, 54 engaged, unless spring tab 42 is depressed and disengages from the OFF position slot.

As can be seen, the fluid dispenser nozzle assembly of the invention requires an additional third step to be performed, a multi-step operation incapable of being carried out by a child. Normally a two-step process for operating something, such as rotating a fluid dispenser nozzle while simultaneously or sequentially unlocking the nozzle from its locked OFF position, is all that is required to render the product child-resistant since it is known that a child of tenure years is normally incapable of performing two sequential or simultaneous operations to unlock or uncover something. However, it is known that even without performing both simultaneous or sequential operations, the stop shoulder or lock can possibly be overridden upon application of a strong turning force especially where additional turning leverage is provided. The present invention therefore goes one step beyond that normally required to render a product child-resistant, by requiring that the nozzle cover be shifted inwardly with pressure maintained as the engaging portions between it and the nozzle cap engage, depressing spring tab 42, and rotating the nozzle cover while maintaining the tab depressed inwardly to effect nozzle cap rotation from its OFF position.

Obviously, many modifications and variations of the present invention are made possible within the light of the above teachings. For example, flange 21 can be of circular or oval outline having a rounded-skirt presenting opposing pairs of side wall portions. Also, both the cap and the cover can be provided with engaging projections 54 in lieu of detents 27 to enable cap rotation upon cover rotation while resilient tab 22 is depressed. It is therefore to be understood that within the scope of the appended claims the invention may be practiced otherwise than as specifically described.

What is claimed is:

1. A fluid dispenser having a dispenser body, a child-resistant nozzle assembly requiring a three-step manipulation for rotation of a nozzle cap about a longitudinal axis thereof between discharge ON and discharge OFF positions, the assembly comprising a nozzle cap supported on said body against axial movement along said axis and for rotation about said axis between said discharge positions, said nozzle cap having means defining at least one stop shoulder lying parallel to said axis, said body having (a spring biased tab for selective engagement with said stop shoulder to prevent rotation of the cap from one of said positions, a nozzle cover surrounding said cap and being rotatable about said axis relative to said cap and being moveable along said axis relative to said cap, said cap and said cover having engaging portions spaced apart in a first longitudinal position to further prevent rotation of the cap by rotation of the cover, and said engaging portions engaging one another in a second longitudinal position of said cover relative to the cap to enable rotation of the cap by rotation of the cover and by selective disengagement of said tab and said shoulder.

2. The dispenser according to claim 1, wherein said cover and said cap respectively have first and second annular surfaces confronting one another, said engaging positions comprising projections on one of said surfaces and recesses on the other of the surfaces for receiving said projections.

3. The dispenser according to claim 1, wherein said stop shoulder is defined by a slot at an upstream end thereof for reception of said tab to prevent the rotation of the cap.

4. The dispenser according to claim 1, wherein said cap is arranged for movement toward said body when the cover is in the first position and is away from said body when the cover is in the second position.

5. The dispenser according to claim 1, wherein the cap has a skirt presenting opposing pairs of side wall portions, said cap having said means defining at least one said stop shoulder in a first opposing pair of said side wall portions, said tab engaging one of said shoulders in one of said first opposing pair of side wall portions to prevent rotation of the cap from said one of said positions.

6. The dispenser according to claim 5, wherein said skirt of said cap is of rectangular cross-section, said opposing pairs of side wall portions comprising opposing pairs of side walls, respectively.

7. The dispenser according to claim 6, wherein at least one of said walls has a radially extending flange thereon containing indicia applied to one side thereof.

8. The dispenser according to claim 6, wherein each of said walls has a radially extending flange thereon containing indicia applied to one side thereof.

9. The dispenser according to claim 5, wherein each said stop shoulder is defined by a slot in each said wall at an upstream end of said skirt for the reception of said tab.

10. The dispenser according to claim 5, wherein one opposing pair of said wall portions has thickened portions at inner surfaces thereof adjacent opposing sides of said slots therein to increase the width of each said shoulder of said slots in said one opposing pair.

11. The dispenser according to claim 10, wherein said thickened portions are tapered to permit the tab to selectively engage one of said slots in one of said opposing pair of walls on cap rotation.

12. The dispenser according to claim 5, wherein the other opposing pair of said wall portions has the shoulders thereof tapering to increase the width of the slots in said other pair at inner sides of the wall portions.

13. The dispenser according to claim 1, wherein the cap has a skirt containing said stop shoulder means, and a radially extending flange on said skirt containing indicia applied to one side thereof.

14. The dispenser according to claim 1, wherein said nozzle cover comprises a cylindrical sleeve.

15. The dispenser according to claim 14, wherein said nozzle cover further comprises a dome-shaped spray shield coaxial with the sleeve and extending from an upstream end thereof.

16. A fluid dispenser comprising, a dispenser body having a forwardly extending discharge nozzle, a nozzle cap mounted on said nozzle for rotation about a longitudinal axis thereof without axial movement therealong, between discharge ON and discharge OFF positions, a nozzle cover surrounding said cap and being rotatable about said axis and being movable along said axis relative to said cap, manually actuatable means acting between said body and said cap for releasably locking said cap against rotation between said discharge positions, and means acting between said cover and said cap in a predetermined relative shifted position of said cover to enable cap rotation upon cover rotation while the manually actuatable means is actuated to release the locking of the cap.

* * * * *